US010707044B1

(12) United States Patent
Hillenbrand

(10) Patent No.: US 10,707,044 B1
(45) Date of Patent: Jul. 7, 2020

(54) BLOCK FUSE AND JUMP START BOX INCLUDING THE BLOCK FUSE

(71) Applicant: Honda Motor Co., Ltd., Minato-ku, Tokyo (JP)

(72) Inventor: Daniel S. Hillenbrand, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/287,576

(22) Filed: Feb. 27, 2019

(51) Int. Cl.

| | |
|---|---|
| ***H01H 85/54*** | (2006.01) |
| ***H01H 85/20*** | (2006.01) |
| ***H01R 13/684*** | (2011.01) |
| ***H01H 85/04*** | (2006.01) |

(52) U.S. Cl.
CPC ..... *H01H 85/54* (2013.01); *H01H 85/04* (2013.01); *H01H 85/2045* (2013.01); *H01R 13/684* (2013.01); *H01H 2085/208* (2013.01)

(58) Field of Classification Search
CPC .... H01R 13/68; H01R 13/684; H01R 13/688; H01R 13/696; H01R 24/28; H01R 9/245; H01H 85/04; H01H 85/54; H01H 85/2045; H01H 2085/208
See application file for complete search history.

(56) References Cited

U.S. PATENT DOCUMENTS

| | | | | |
|---|---|---|---|---|
| 3,202,788 | A | 8/1965 | George | |
| 3,639,882 | A * | 2/1972 | Honda | B60K 37/02 439/34 |
| 4,371,743 | A | 2/1983 | Decker | |
| 4,482,176 | A | 11/1984 | Rider, Jr. | |
| 5,088,940 | A * | 2/1992 | Saito | H01H 85/205 439/620.34 |
| 5,405,035 | A * | 4/1995 | Kato | H05K 5/0013 220/3.8 |
| 5,906,514 | A | 5/1999 | Nelson, Jr. | |
| 6,178,106 | B1 * | 1/2001 | Umemoto | H01R 11/12 363/146 |
| 6,679,708 | B1 * | 1/2004 | Depp | H01R 9/2466 361/752 |
| 7,878,822 | B2 | 2/2011 | Korczynski | |
| 2004/0235315 | A1 * | 11/2004 | Masui | B60K 1/04 439/34 |
| 2017/0148600 | A1 * | 5/2017 | Carnick | H01H 85/0241 |
| 2017/0232911 | A1 * | 8/2017 | Carnick | B60R 16/0215 49/395 |

FOREIGN PATENT DOCUMENTS

| | | | |
|---|---|---|---|
| CN | 104882343 | A | 9/2015 |
| CN | 204966439 | U | 1/2016 |
| CN | 106504958 | A | 3/2017 |
| CN | 206271649 | U | 6/2017 |
| KR | 200479836 | Y1 | 3/2016 |

* cited by examiner

*Primary Examiner* — Oscar C Jimenez
(74) *Attorney, Agent, or Firm* — Honda Patents & Technologies North America, LLC; Andrew Kefalonitis, Jr.

(57) ABSTRACT

A block fuse including a body and a plurality of fuses coupled to the body is described herein. The block fuse also includes a plurality of electrical connectors extending from the body in a first direction and electrically coupled to the plurality of fuses, and at least one block fuse removal tab extending from the body in a second direction, opposite to the first direction.

18 Claims, 6 Drawing Sheets

BLOCK FUSE AND JUMP START BOX INCLUDING THE BLOCK FUSE

BACKGROUND

Commonly, vehicles that include internal combustion engines also include a battery used in combination with an electric starter motor to start the engine. If the battery charge is low, the engine will not start. Jump starting the battery by connecting it to a second vehicle's battery and/or electrical system using jumper cables is a typical technique used to start the engine. The electrical terminals of the battery are often accessible by merely opening the hood and removing a protective cap positioned over one of the terminals.

However, some vehicles are designed with the battery positioned in an inaccessible position. For example, the battery may be positioned under flooring in the vehicle trunk, under a vehicle seat, or within the engine compartment, but not readily accessible.

A remote positive terminal, which may be positioned in what is referred to as a jump start box, is known to be used in vehicles that have inaccessible battery terminals. The remote positive terminal is electrically coupled to a positive terminal of the vehicle battery. The jump start box is located within the vehicle where it can be easily accessed by the user. Furthermore, known jump start boxes may also include a block fuse containing multiple fuses. Removal of the block fuse from the jump start box is known to be challenging and potentially cause bending and/or damage to block fuse terminals.

SUMMARY

Examples of the disclosure facilitate removal of a block fuse from a jump start box in an ergonomic manner while preventing damage to both the block fuse and the jump start box.

In one aspect, a block fuse is described herein. The block fuse includes a body and a plurality of fuses coupled to the body. The block fuse also includes a plurality of electrical connectors extending from the body in a first direction and electrically coupled to the plurality of fuses, and at least one block fuse removal tab extending from the body in a second direction, opposite to the first direction.

In another aspect, a block fuse is described herein. The block fuse includes a body, at least one fuse coupled to the body, and at least one electrical connector extending from the body and electrically coupled to the at least one fuse. The block fuse also includes a jump start terminal extending from the body andat least one block fuse removal tab extending from the body in a direction substantially parallel to the jump start terminal.

In yet another aspect, a jump start box is described herein. The jump start box includes a base portion, a plurality of terminals at least one of coupled to and included within the base portion, and a block fuse. The block fuse includes a plurality of electrical connectors configured to be removably coupled to the plurality of terminals. The block fuse further includes at least one block fuse removal tab extending in a substantially opposite direction to the plurality of electrical connectors.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1:
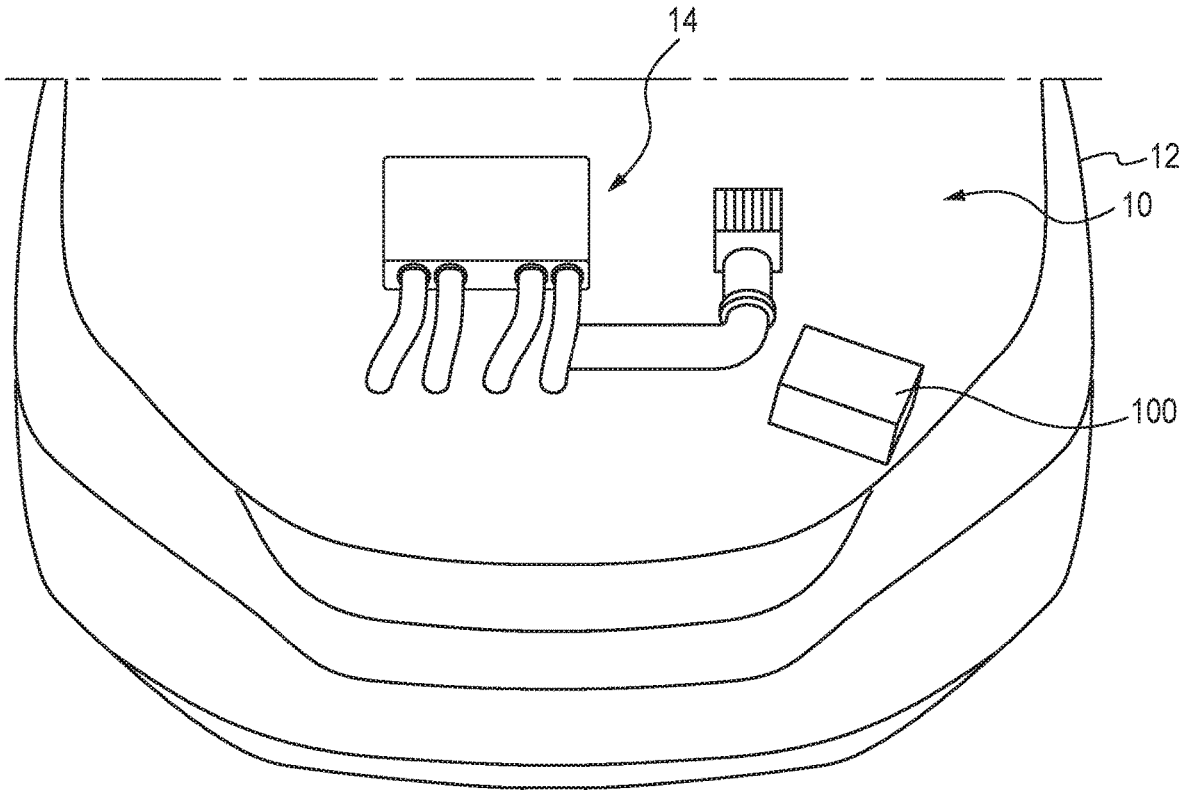
FIG. 1 is a perspective view of an engine bay of an exemplary vehicle.

Corresponding reference characters indicate corresponding parts throughout the drawings. Although specific features may be shown in some of the drawings and not in others, this is for convenience only. In accordance with the examples described herein, any feature of a drawing may be referenced and/or claimed in combination with any feature of any other drawing.

DETAILED DESCRIPTION

The present disclosure relates generally to a jump start box that includes a block fuse and, more specifically, to a block fuse that includes at least one removal tab to facilitate ergonomic and efficient removal of the block fuse from the jump start box. Examples described herein include block fuses that include removal tabs positioned and configured to efficiently transfer a force applied by a user to the block fuse to enable removal of the block fuse without causing damage to electrical connectors included in the block fuse and/or to corresponding terminals. In one aspect, the block fuse includes at least one block fuse removal tab extending from the block fuse and providing a gripping surface allowing the user to more easily remove the block fuse from the jump start box. While the examples described herein are described with respect to removal of a block fuse from a jump start box that includes a jump start terminal, one of ordinary skill in the art would understand and appreciate that the example systems and methods may be used to facilitate removal of a block fuse used in other applications.

FIG. 1 is a perspective view of an engine bay 10 of an exemplary vehicle 12. Within engine bay 10 is an engine 14 and a jump start box 100. Jump start box 100, which may also be referred to as a fuse box, is included as a portion of a known vehicle electrical system. The known vehicle electrical system may include, for example, a vehicle battery, an alternator, a starter motor, and associated wiring for electrically coupling together these components and other electrical components within vehicle 12. For example, jump start box 100 may be included in a vehicle whose battery is not positioned in engine bay 10 and/or is not easily accessible. More specifically, jump start box 100 may be positioned within engine bay 10 where a vehicle battery was typically positioned. Alternatively, jump start box 100 may be positioned within engine bay 10 in such a manner as to be visible and easily accessed in a situation where the vehicle battery does not have enough charge to start the engine (i.e., a situation where a jump start of the engine is desired). In a further alternative embodiment, jump start box 100 may be positioned within a cabin of the vehicle and/or in any other position accessible to the user in a situation where a jump start of the engine is desired.

Figure 2:
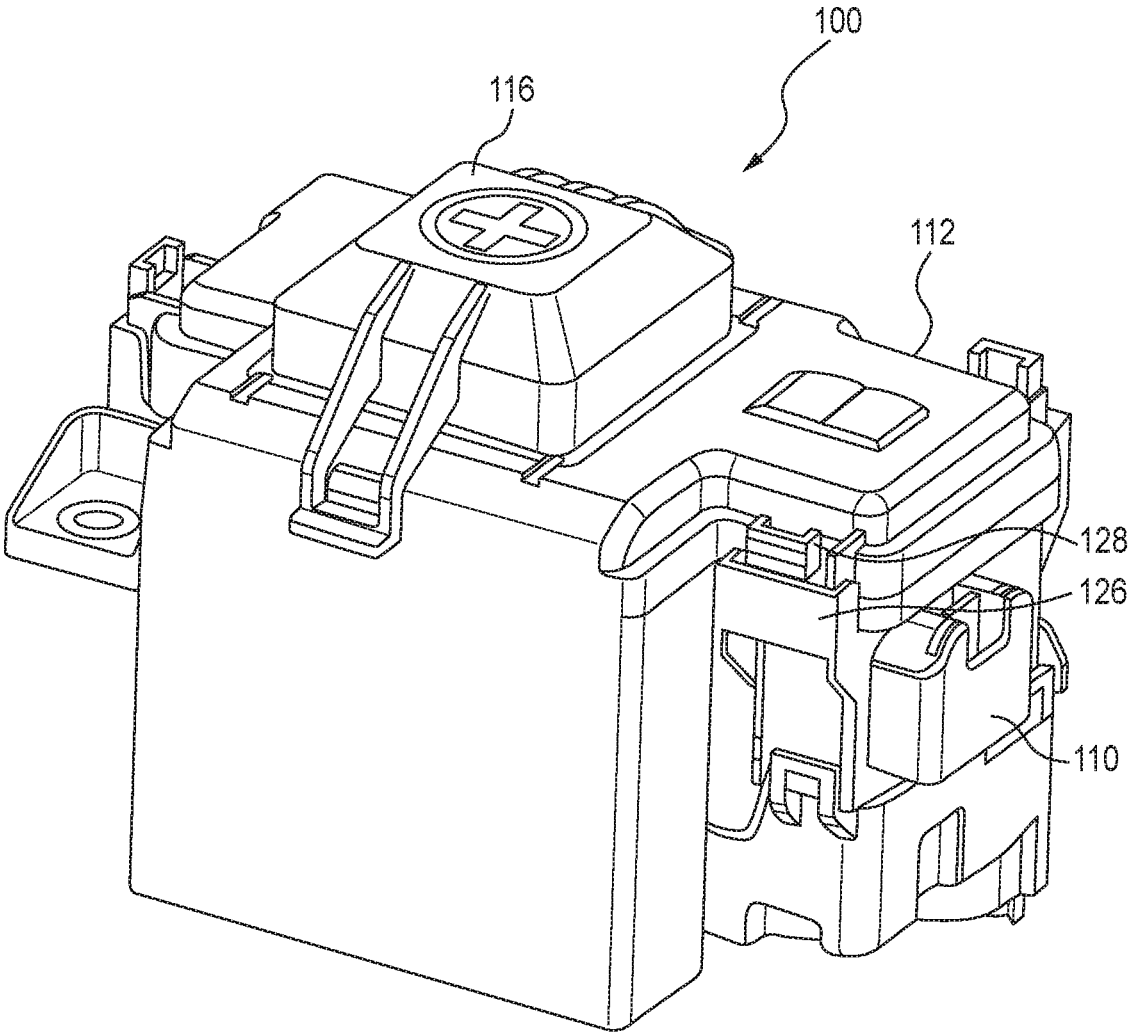
FIG. 2 is a perspective view of an exemplary embodiment of a jump start box that may be included in the vehicle shown in FIG. 1.

FIG. 2 is a perspective view of an exemplary embodiment of jump start box 100 (shown in FIG. 1). In the illustrated embodiment, jump start box 100 includes a base portion 110 and a cover 112. Furthermore, cover 112 includes a jump start terminal opening (not shown in FIG. 2) defined therein and configured to provide access to a jump start terminal 114 (shown in FIG. 3). Jump start terminal 114 is a remote positive terminal that is electrically coupled to a positive terminal of the vehicle battery. Furthermore, cover 112 further includes a jump start terminal opening cover 116 configured to selectively provide access to jump start terminal 114.

Figure 3:
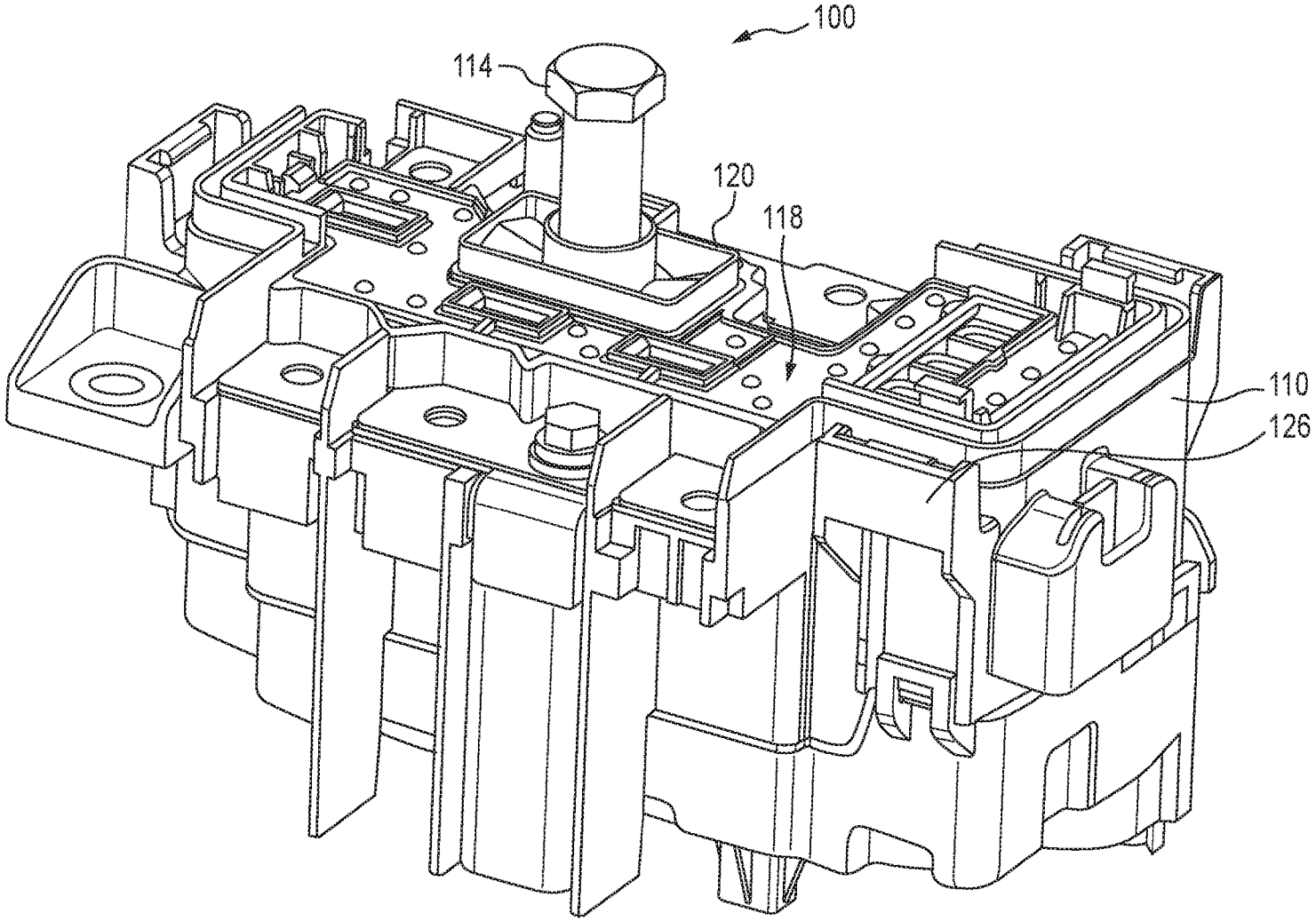
FIG. 3 is a perspective view of the jump start box shown in FIG. 2 with a cover removed.

FIG. 3 is a perspective view of jump start box 100 (shown in FIG. 2) with cover 112 removed in order to show an interior 118 of jump start box 100. In the exemplary embodiment, jump start box 100 includes a block fuse 120 removably coupled to base portion 110.

Figure 4:
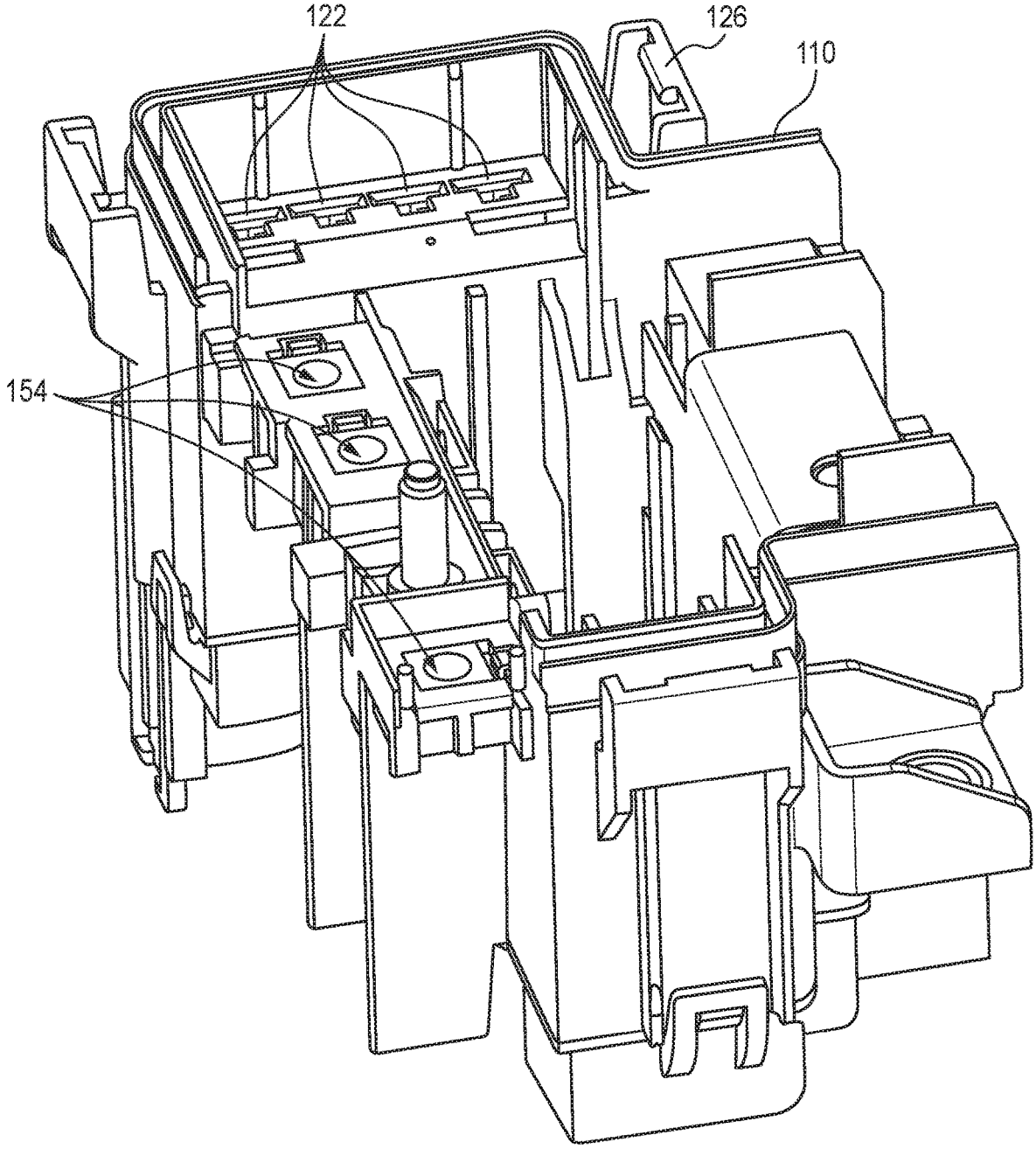
FIG. 4 is a perspective view of an exemplary base portion of the jump start box shown in FIG. 2.

FIG. 4 is a perspective view of base portion 110. Base portion 110 includes a plurality of terminals 122 at least one of coupled to and included within base portion 110. Base portion 110 also includes at least one attachment surface 126 and cover 112 (shown in FIG. 2) includes at least one corresponding attachment surface 128. Attachment surfaces 126 and 128 are configured to removably couple base portion 110 together with cover 112. In the illustrated embodiment, attachment surfaces 126 include slots and attachment surfaces 128 include locking tabs configured to fit at least partially within the slots. Cover 112, when coupled to base portion 110, defines interior 118 of jump start box 100. When coupled to base portion 110, block fuse 120 is included within interior 118 of jump start box 100.

Figure 5:
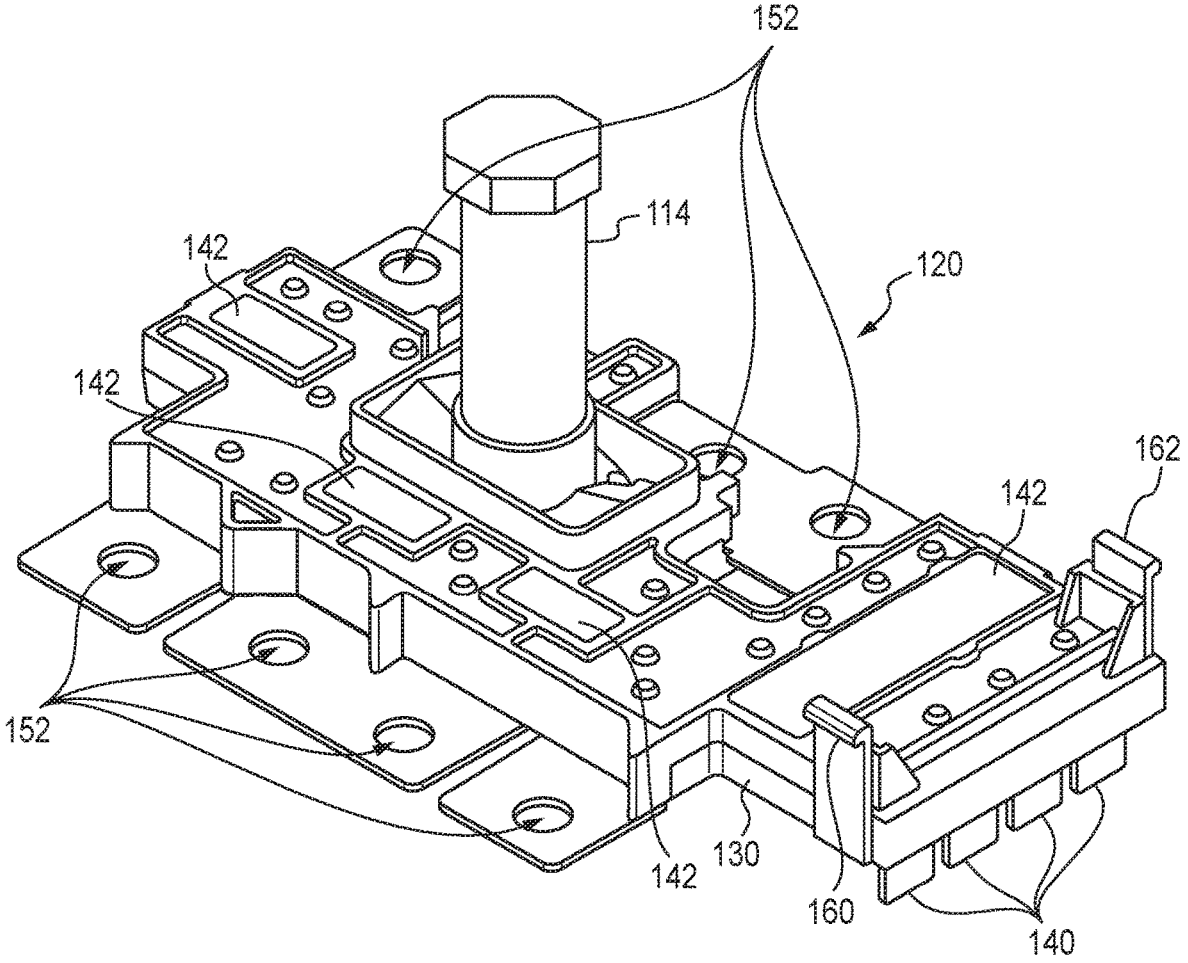
FIG. 5 is a perspective view of an exemplary block fuse that may be included in the jump start box shown in FIG. 2.
Figure 6:
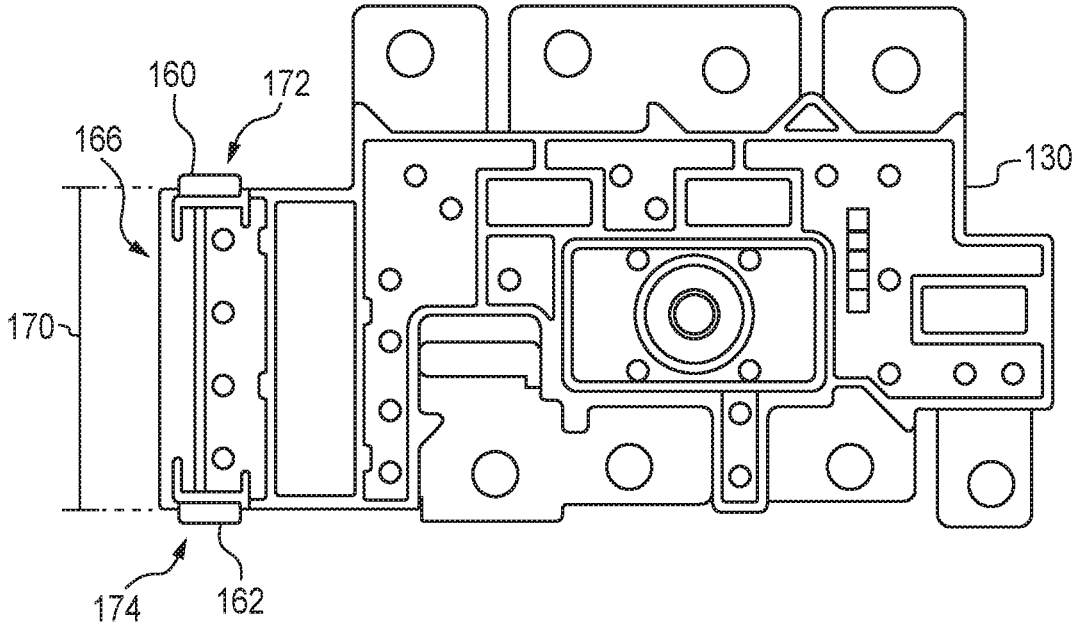
FIG. 6 is a top view of the block fuse shown in FIG. 5.
Figure 7:
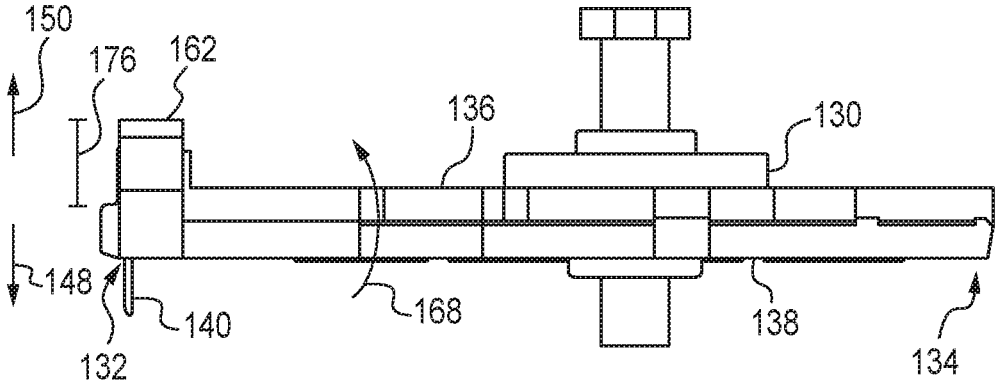
FIG. 7 is a side view of the block fuse shown in FIG. 5.

FIG. 5, FIG. 6, and FIG. 7 are additional views of an exemplary block fuse, for example, block fuse 120 (shown in FIG. 3). More specifically, FIG. 5 is a perspective view of block fuse 120. FIG. 6 is a top view of block fuse 120. FIG. 7 is a side view of block fuse 120. In the exemplary embodiment, block fuse 120 includes a body 130. Body 130 includes a first end 132, a second end 134, a first surface 136 (e.g., an upper surface), and a second surface 138 (e.g., a lower surface). Block fuse 120 further includes a plurality of electrical connectors 140, a plurality of fuses 142, and jump start terminal 114. Body 130 includes conductive elements and insulating elements that facilitate removably coupling block fuse 120 to the rest of jump start box 100, as well as electrically coupling fuses 142 to the vehicle electrical system. In the exemplary embodiment, electrical connectors 140 correspond to the plurality of terminals 122. For example, the terminals 122 may include blade terminals and electrical connectors 140 may include blade connectors configured to couple with the blade terminals. Alternatively, the terminals 122 and electrical connectors 140 may be any other type of electrical connector that allows jump start box 100 to function as described herein.

In the exemplary embodiment, electrical connectors 140 are positioned at first end 132 of body 130 and extend from second surface 138 of body 130 in approximately a first direction 148. Jump start terminal 114 extends from first surface 136 of body 130 in approximately a second direction 150, wherein the second direction 150 is opposite first direction 148. Furthermore, electrical connectors 140 are electrically coupled to the plurality of fuses 142 through conductive elements within body 130.

In the exemplary embodiment, block fuse 120 also includes a plurality of openings 152 defined within body 130, each configured to receive a threaded coupler (not shown in FIG. 5). In the illustrated embodiment, block fuse 120 includes eight openings 152 configured to align with threaded openings, for example, threaded openings 154 (shown in FIG. 4) included within base portion 110. Threaded couplers, for example screws, are inserted through the plurality of openings 152 and into the base portion openings to physically couple block fuse 120 together with base portion 110.

In a situation where a user desires to remove block fuse 120 from base portion 110, for example, in order to replace block fuse 120 or individual fuses 142 within block fuse 120, the user first removes the screws coupling block fuse 120 together with base portion 110. The user then needs to separate electrical connectors 140 from terminals 122. To remove a block fuse from a known jump start box, users often pull on jump start terminal 114, as it may appear to be the most convenient portion of the block fuse to hang onto. However, attempting to pull block fuse 120 in second direction 150 by pulling on jump start terminal 114 instead causes a rotational force approximately around first end 132 of block fuse 120. That is, instead of a motion in second direction 150, pulling on jump start terminal 114 causes motion in an arc 168. This rotation subjects block fuse 120, and more specifically electrical connectors 140 and portions of body 130 near electrical connectors 140, to forces that may cause damage to block fuse 120 and/or base portion 110.

In the exemplary embodiment, block fuse 120 also includes at least one block fuse removal tab, for example, first block fuse removal tab 160 and second block fuse removal tab 162, positioned at first end 132 of body 130 and extending from first surface 136 in second direction 150. For example, block fuse removal tabs 160 and 162 may be included as a portion of body 130. Alternatively, block fuse removal tabs 160 and 162 may be coupled to body 130. Block fuse removal tabs 160 and 162 are substantially aligned with electrical connectors 140, that is, block fuse removal tabs 160 and 162 extend from first surface 136 at first end 132 of body 130 and electrical connectors 140 are also positioned at first end 132, extending from the opposite surface (i.e., second surface 138).

In the exemplary embodiment, first block fuse removal tab 160 is positioned a first distance 170 from second block fuse removal tab 162. First distance 170 is a distance that allows a user to press on an outer side 172 of first block fuse removal tab 160 with a thumb and an outer side 174 of second block fuse removal tab 162 with a finger on the same hand. Alternatively, the user may alternately pull first block fuse removal tab 160 and second block fuse removal tab 162 until the electrical connectors 140 are removed from the terminals 122. Moreover, the user may use one hand to grasp first block fuse removal tab 160 and the other hand to grasp second block fuse removal tab 162. Block fuse removal tabs 160 and 162 extend a distance 176 from first surface 136 of body 130. Distance 176 is selected to facilitate gripping by fingers of a user. Distance 176 is also selected such that block fuse removal tabs 160 and 162 can be positioned within interior 118 of jump start box 100 (i.e., under cover 112).

Block fuse removal tabs 160 and 162 provide convenient and ergonomic surfaces which can be held by a user, and, when pulled by the user, facilitate separation of electrical connectors 140 from terminals 122. By virtue of the position of removal tabs 160 and 162, when a user pulls on removal tabs 160 and 162, block fuse 120 moves substantially linearly in second direction 150 (i.e., without rotation around first end 132), facilitating separation of electrical connectors 140 from terminals 122 without damage to block fuse 120 or base portion 110. Furthermore, removal tabs 160 and 162 provide an intuitive method of removing block fuse 120, allowing for a better understanding of how to remove the block fuse 120 and reducing the time spent analyzing how to remove the block fuse 120.

Example jump start boxes and corresponding block fuses are described herein and illustrated in the accompanying drawings. The exemplary block fuses include at least one removal tab to facilitate ergonomic and efficient removal of the block fuse from the jump start box. Examples described herein include removal tabs positioned and configured to efficiently transfer a force applied by a user to the block fuse to enable removal of the block fuse without causing damage to electrical connectors included in the block fuse and/or the jump start box. In one aspect, the block fuse includes at least one block fuse removal tab extending from the block fuse and providing a gripping surface allowing the user to more easily remove the block fuse from the jump start box.

Having described aspects of the disclosure in terms of various examples with their associated operations, it will be apparent that modifications and variations are possible without departing from the scope of the disclosure as defined in the appended claims. That is, aspects of the disclosure are not limited to the specific examples described herein, and all matter contained in the above description and shown in the accompanying drawings shall be interpreted as illustrative and not in a limiting sense.

Components of the systems and/or operations of the methods described herein may be utilized independently and separately from other components and/or operations described herein. Moreover, the methods described herein may include additional or fewer operations than those disclosed, and the order of execution or performance of the operations described herein is not essential unless otherwise specified. That is, the operations may be executed or performed in any order, unless otherwise specified, and it is contemplated that executing or performing a particular operation before, contemporaneously with, or after another operation is within the scope of the disclosure. Although specific features of various examples of the disclosure may be shown in some drawings and not in others, this is for convenience only. In accordance with the principles of the disclosure, any feature of a drawing may be referenced and/or claimed in combination with any feature of any other drawing.

When introducing elements of the disclosure or the examples thereof, the articles "a," "an," "the," and "said" are intended to mean that there are one or more of the elements. References to an "embodiment" or an "example" of the present disclosure are not intended to be interpreted as excluding the existence of additional embodiments or examples that also incorporate the recited features. The terms "comprising," "including," and "having" are intended to be inclusive and mean that there may be elements other than the listed elements. The phrase "one or more of the following: A, B, and C" means "at least one of A and/or at least one of B and/or at least one of C."

The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A block fuse comprising:

a body including a first end and a second end;

a plurality of fuses coupled to said body;

a plurality of electrical connectors extending from said first end of said body in a first direction and electrically coupled to said plurality of fuses;

a jump start terminal extending from said body in a second direction, opposite to said first direction; and at least one block fuse removal tab extending from said first end of said body, parallel to said plurality of electrical connectors, in said second direction.

2. The block fuse according to claim 1, wherein said body is configured to be included within a jump start box of a vehicle.

3. The block fuse according to claim 2, wherein said plurality of electrical connectors are blade connectors configured to be coupled with corresponding blade terminals included in a base portion of said jump start box.

4. The block fuse according to claim 1, wherein said at least one block fuse removal tab comprises a first block fuse removal tab and a second block fuse removal tab.

5. The block fuse according to claim 4, wherein said first block fuse removal tab is positioned a first distance from said second block fuse removal tab.

6. The block fuse according to claim 1, wherein a position of said at least one block fuse removal tab relative to said plurality of electrical connectors facilitates transfer of a substantially linear pulling force applied to said at least one block fuse removal tab to said plurality of electrical connectors.

7. A block fuse comprising: a body; at least one fuse coupled to said body; at least one electrical connector extending from said body and electrically coupled to said at least one fuse; a jump start terminal extending from said body in a first direction; and at least one block fuse removal tab extending from said body in a the first direction and substantially parallel to said jump start terminal; wherein said body comprises a first end and a second end, and wherein said at least one electrical connector and said at least one block fuse removal tab are positioned at said first end, and said at least one electrical connector extends in a second direction, opposite to said first direction.

8. A jump start box comprising:

a base portion;

a plurality of terminals at least one of coupled to and included within said base portion; and a block fuse comprising a plurality of electrical connectors configured to be removably coupled to said plurality of terminals, at least one block fuse removal tab extending in a substantially opposite direction to said plurality of electrical connectors, and a jump start terminal extending in substantially the same direction as said at least one block fuse removal tab.

9. The jump start box in accordance with claim 8, further comprising a cover removably coupled to said base portion that, when coupled to said base portion, defines an interior of said jump start box.

10. The jump start box in accordance with claim 9, wherein said block fuse is included within said interior of said jump start box.

11. The jump start box in accordance with claim 9, wherein said cover and said base portion each comprise a plurality of corresponding attachment surfaces configured to removably couple said cover together with said base portion.

12. The jump start box in accordance with claim 9, wherein said cover includes a jump start terminal opening defined therein and configured to provide access to a jump start terminal.

13. The jump start box in accordance with claim 9, wherein said block fuse further comprises a jump start terminal extending in substantially the same direction as said at least one block fuse removal tab, and wherein said cover further comprises a jump start terminal opening cover configured to selectively provide access to said jump start terminal.

14. The jump start box in accordance with claim 8, wherein said at least one block fuse removal tab is configured to provide a surface which can be held by a user, and, when pulled by the user, facilitate separation of said electrical connectors and said terminals.

15. The jump start box in accordance with claim 8, wherein said at least one block fuse removal tab comprises a first block fuse removal tab and a second block fuse removal tab, wherein said first block fuse removal tab is positioned a first distance from said second block fuse removal tab, and wherein said first distance is a distance that allows a user to press on an outer side of said first block fuse removal tab with a thumb and an outer side of said second block fuse removal tab with a finger on the same hand.

16. The jump start box according to claim 8, wherein a position of said at least one block fuse removal tab relative to said plurality of electrical connectors facilitates transfer of a substantially linear pulling force applied to said at least one block fuse removal tab to said plurality of electrical connectors.

17. The jump start box according to claim 8, wherein said at least one block fuse removal tab is substantially aligned with said plurality of electrical connectors, wherein said at least one block fuse removal tab extends from a first surface at a first end of said block fuse and said plurality of electrical connectors are also positioned at the first end, extending from a second surface of said block fuse opposite to said first surface.

18. The jump start box according to claim 8, wherein said plurality of electrical connectors are blade connectors and said plurality of terminals are blade terminals configured to couple with said blade connectors.

* * * * *